United States Patent [19]

de Winter

[11] 4,417,828

[45] Nov. 29, 1983

[54] EROSION PROTECTION MAT

[75] Inventor: Jan G. de Winter, Enschede, Netherlands

[73] Assignee: Nicolon B.V., Enschede, Netherlands

[21] Appl. No.: 300,673

[22] Filed: Sep. 9, 1981

[30] Foreign Application Priority Data

Sep. 15, 1980 [NL] Netherlands ..... 8005159

[51] Int. Cl.[3] ..... E02B 3/12

[52] U.S. Cl. ..... 405/17; 404/35; 404/28

[58] Field of Search ..... 405/17; 404/35, 40, 404/18, 73, 71, 28, 70, 45

[56] References Cited

U.S. PATENT DOCUMENTS

| | | | |
|---|---|---|---|
| 450,286 | 4/1891 | Enricht | 404/18 |
| 1,187,503 | 6/1916 | Chenoweth | 405/17 |
| 1,358,042 | 11/1920 | Warmoth | 405/17 X |
| 1,549,802 | 8/1925 | Rabon | 404/70 |
| 1,613,063 | 1/1927 | Stark | 404/70 |
| 2,151,505 | 3/1939 | Elmendorf | 404/40 X |
| 2,229,742 | 1/1941 | Kauffman | 404/73 X |
| 3,148,482 | 9/1964 | Neale | 404/45 X |
| 3,344,608 | 10/1967 | McEachran | 404/70 X |
| 3,386,252 | 6/1968 | Nelson | 404/40 X |
| 4,227,829 | 10/1980 | Landry | 404/40 X |

FOREIGN PATENT DOCUMENTS

| | | |
|---|---|---|
| 1813450 | 7/1969 | Fed. Rep. of Germany . |
| 7008831 | 6/1971 | Netherlands . |
| 7213540 | 4/1974 | Netherlands . |
| 7904906 | 12/1980 | Netherlands . |

*Primary Examiner*—Nile C. Byers, Jr.

*Attorney, Agent, or Firm*—Diller, Ramik & Wight

[57] ABSTRACT

A tissue mat protecting against erosion comprising a water-pervious tissue layer provided with anchoring loops. The anchoring loops have the form of a yarn woven across the tissue and protruding from the surface of the tissue. It is possible to use a rugged yarn guaranteeing a satisfactory anchorage to this end. The anchoring loops of the tissue ensure that the mat penetrates into the ground and is thus anchored. It is also possible to anchor concrete blocks of means of the anchoring loops by pouring the concrete on the mat or by pressing it thereon.

7 Claims, 4 Drawing Figures

EROSION PROTECTION MAT

The invention relates to a mat protecting against erosion comprising a water-pervious tissue layer provided with anchoring loops.

Such a tissue mat is known from European Patent Application No. 80.200582.7. In this known mat the anchoring loop is provided by means of so-called "tufting" after the mat has been woven. In the first place this requires an additional operation and it is furthermore not possible to use a very rigid yarn ensuring a satisfactory anchorage. Moreover, the tufted yarn is lying relatively loosely in the tissue so that also for this reason a less satisfactory anchorage is obtained.

The invention has for its object to obviate this disadvantage.

According to the invention this is achieved by shaping the anchoring loops in the form of a yarn woven across the tissue and protruding from the surface of the tissue. Since the anchoring yarn is provided as a tissue yarn during the weaving operation, it is possible to use a rugged yarn guaranteeing a satisfactory anchorage to this end, whilst no additional operational run is required.

The mat may be employed for bank protection, talus protection and at other erosion-sensitive places. It is, of course, important for the mat to reliably adhere to the subjacent ground. The anchoring loops of the tissue ensure that the mat penetrates into the ground and is thus anchored. If desirable, the mat may be covered with stones, blocks or the like. When an anchoring mat having anchoring loops protruding on both sides of the tissue surface is employed, the stones or blocks deposited on the mat are satisfactorily retained. It is also possible to anchor concrete blocks by means of the anchoring loops by pouring the concrete on the mat or by pressing it thereon. Since a large number of loops is used and many loops are made from a single continuous yarn a given resistance against lateral bending forces is produced so that an intimate adhesion between the tissue layer and the blocks is obtained. In the anchoring technique according to the invention the blocks can be poured or pressed on the tissue.

The loops may be locally arranged at uniform intervals. The places of the loops are chosen in dependance on the desired places for the blocks.

The yarn is preferably a mono-thread yarn of polypropylene. This material very satisfactorily adheres to concrete. The height of the loop may be 5 mms and the yarn diameter may be 0.25 mm.

The invention will be described with reference to the drawings

The mat 1 comprises a tissue layer 2 and blocks 3, for example, concrete elements connected with said layer. The tissue layer 2 and the blocks 3 are pervious to water. For the blocks 3 this is achieved by making a hole 4. The perviousness to sand is determined inter alia by the composition of the weft yarn serving as an anchoring means.

Figure 1:
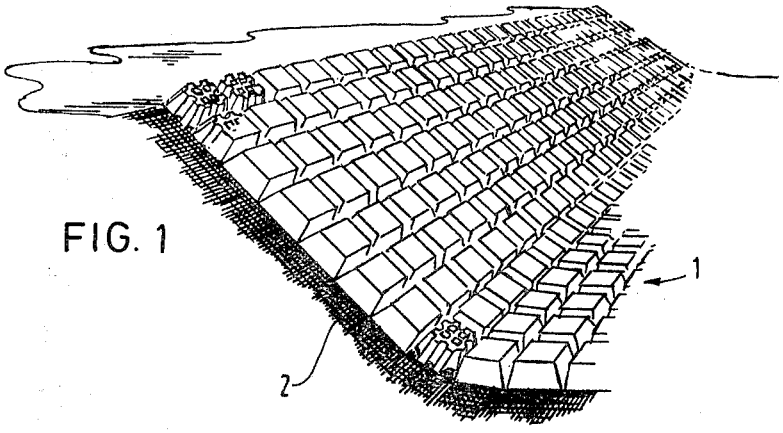
FIG. 1 shows a mat embodying the invention used for talus protection.
Figure 2:
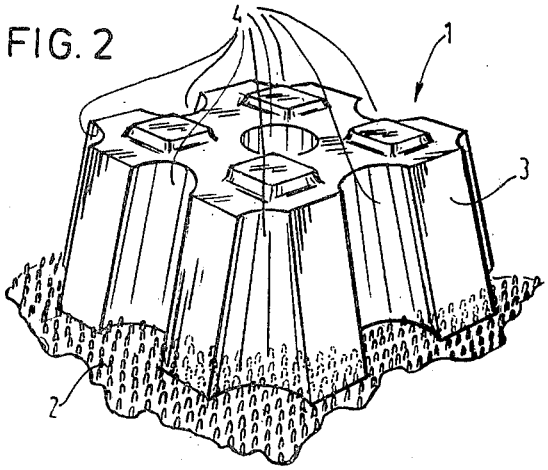
FIG. 2 is a perspective view of part of the mat embodying the invention.
Figure 3:
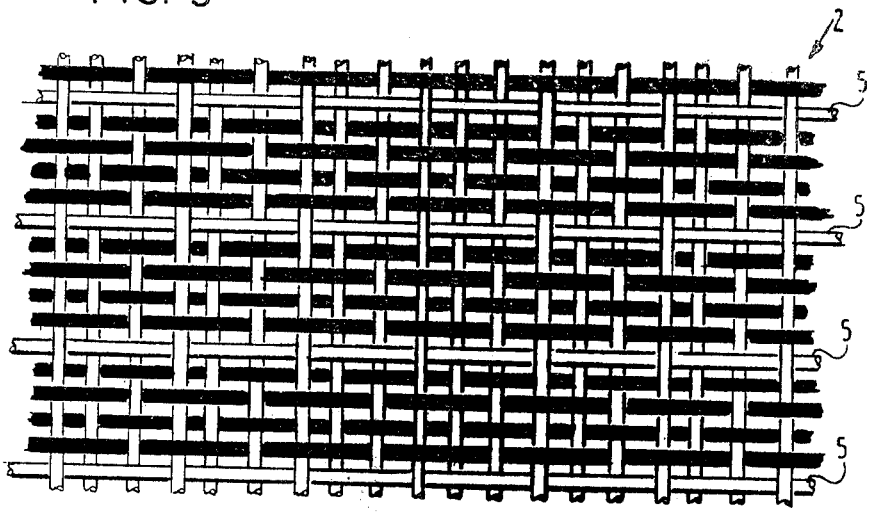
FIG. 3 is an enlarged plan view of the tissue of the mat.
Figure 4:
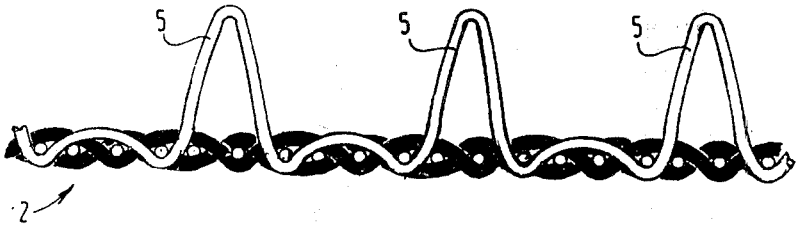
FIG. 4 is a longitudinal sectional view of the tissue of the mat embodying the invention.

FIG. 4 shows that a continuous yarn 5, for example, of polypropene is woven to form triangular loops protruding from the surface. The continuous interwoven yarn 5 ensures a very satisfactory rigidity so that during pouring or pressing of the blocks 3 the vertical position is maintained. The loops of the yarn 5 are substantially triangular, the basis of the triangle being located approximately in the plane of the tissue.

It should be noted that the interwoven yard is not a so-called tuft yarn.

What I claim is:

1. An erosion-protecting mat comprising a water-pervious tissue layer having anchoring loops projecting outwardly from at least one surface of the tissue, the anchoring loops being integral portions of a yarn woven across the tissue and periodically protruding from said surface of the tissue.

2. A mat as claimed in claim 1 wherein the anchoring loops are anchored in concrete blocks.

3. A mat as claimed in claim 1 or 2 wherein the yarn is a mono-thread yarn.

4. A mat as claimed in anyone of claims 1 or 2 wherein the yarn is made from polypropene.

5. A mat as claimed in anyone of claims 1 or 2 wherein the loops have a height of 5 mms and the yarn has a diameter of 0.25 mm.

6. A mat as claimed in anyone of claims 1 or 2 wherein the loops are triangular and the basis of the triangle is located in the plane of the tissue.

7. A mat as claimed in anyone of claims 1 or 2 wherein the anchoring loops protrude on both sides of the tissue.

* * * * *